US005751666A

United States Patent [19]

Farine et al.

[11] Patent Number: 5,751,666

[45] Date of Patent: May 12, 1998

[54] ELECTRONIC TIMEPIECE COMPRISING A GENERATOR DRIVEN BY A SPRING BARREL

[75] Inventors: Pierre-André Farine, Neuchâtel; Jean-Jacques Born, Morges, both of Switzerland

[73] Assignee: Asulab S.A., Bienne, Switzerland

[21] Appl. No.: 903,788

[22] Filed: Jul. 31, 1997

[30] Foreign Application Priority Data

Aug. 1, 1996 [FR] France ..... 96 09747

[51] Int. Cl.[6] ..... G04B 1/00; G04B 1/10

[52] U.S. Cl. ..... 368/140; 368/203; 368/204

[58] Field of Search ..... 368/66, 140, 155–157, 368/203–204

[56] References Cited

U.S. PATENT DOCUMENTS 5,517,469 5/1996 Wiget ..... 368/140

5,699,322 12/1997 Born ..... 368/66

FOREIGN PATENT DOCUMENTS 239820 10/1987 European Pat. Off. .

2397748 2/1979 France .

*Primary Examiner*—Vit W. Miska

*Attorney, Agent, or Firm*—Sughrue, Mion, Zinn, Macpeak & Seas, PLLC

[57] ABSTRACT

The integrated circuit (11) of this timepiece comprises means (16, 17, 18) for comparing the frequency of a time base (12, 13) to the frequency of the generator (1). The error signal thereby generated is examined by a wired logic (20) allowing verification of whether this signal passes distinct threshold values.

Passing of two of these values allows an electric brake (22) of the generator to be controlled so that from a certain degree of depletion of the power reserve of the barrel (5), the second hand moves periodically right away over an angle of several seconds inviting the wearer of the timepiece to rewind the spring (6) of the barrel (5).

7 Claims, 2 Drawing Sheets

Torque
(g.mm)
A2
1000
B1
A
B
EOL
C
critical
T
Cc
A1, B2
I
N
0
1
2
3
4
5
6
7
(revolution)
PFI
PFP 11
frequency divider
13
14
15
reversible counter
16
19
decision logic
20
21
12
17
18
POR circuit
23
23a
23b
22
25
24
7
8
9
5
6
4
2
1
3
1a
1b
10
VSS
VDD

ELECTRONIC TIMEPIECE COMPRISING A GENERATOR DRIVEN BY A SPRING BARREL

The present invention concerns an electronic timepiece of the type comprising an energy source consisting of a spring barrel, with manual or automatic winding, coupled to an a.c. generator intended to supply the electronic circuits of the timepiece via a rectifier.

Such a timepiece is disclosed in Swiss Patent No 686 332, this document concerning, in particular, a control circuit allowing the speed of rotation of the generator to be slaved to a desired or set speed which corresponds to the proper working of the timepiece, as long as the energy of the spring barrel is sufficient to maintain this speed of rotation at the desired value.

Fitting a timepiece with a device for indicating the power reserve in order to inform the user of the timepiece when the barrel spring is depleted, is already known. Such a device is disclosed in European Patent Application EP 0 762 243 in the name of the present Applicant.

This device operates more or less in the following manner. During the normal running time, the generator coupled directly to the barrel tends to rotate too quickly and thus to provide a voltage whose frequency is higher than a desired frequency value derived from a frequency standard operating on the basis of a clock quartz. The generator must therefore be braked, which is achieved by periodically short-circuiting its coil. The number of brakings necessary in order to maintain the generator at the nominal speed is high at the beginning of the letting down of the spring and gradually decreases as the energy accumulated in the spring is depleted.

The value of this number may thus be used to determine when the energy of the spring will no longer be sufficient to maintain the proper working of the timepiece. According to the concept disclosed in the aforecited Patent Application, the number of successive brakings is counted during successive periods of time of fixed length and if the number becomes less than a predetermined value during such a period of time, a display device can be triggered warning the user that the power reserve will soon be exhausted. The information may also be used so as to display an indication of the number of hours during which the power reserve will still be sufficient to allow display of the correct time.

Thus this prior timepiece must comprise, in addition to the hands indicating the time, another device such as a window behind which an indicator, which must be specially driven, moves as a function of the state of depletion of the power reserve.

Battery operated electronic timepieces comprising a device allowing the degree of battery depletion to be indicated, by means of a particular movement of one of the hands, in particular the second hand, are also known. Generally, these devices operate so that when the battery voltage falls below a predetermined minimum value, there is a disruption to the movement of the second hand which for example instead of beating every second, takes a step of two seconds on the dial every two seconds.

An aim of the invention is to provide an electronic timepiece having a generator driven by a spring barrel wherein the presence of a special power reserve depletion display device is eliminated, but wherein, on the other hand, such depletion can be indicated with the aid of a particular movement of the second hand as is the case in conventional quartz timepieces driven by a motor and supplied by a battery.

The invention thus concerns an electronic timepiece comprising:

an a.c. voltage generator connected to an electronic circuit of the timepiece, a spring barrel coupled to said generator for the driving thereof, a set of time indicating hands also driven by said barrel, said electronic circuit comprising:

a time base intended to provide a standard frequency signal, comparing means for comparing the frequency of said time base to the frequency of said a.c. voltage in order to generate an error signal, and verifying means connected to said comparing means for verifying whether said error signal passes a first predetermined threshold, and braking means controlled by said verifying means for electrically braking said generator when said error signal passes said first predetermined threshold, said timepiece being characterised in that said verifying means are also arranged for verifying whether said error signal passes a second predetermined threshold greater than said first predetermined threshold and evidencing a predetermined degree of depletion of the power reserve of said barrel, said braking means also being controlled when said second threshold is passed, said verifying means also being arranged to verify whether, after said error signal has passed said second predetermined threshold, said error signal becomes at least equal to a third predetermined threshold, during a predetermined period of time for controlling said braking means at the expiry of said period;

in such a way that said hands indicate said state of depletion by a rotation at a speed greater than the speed corresponding to the indication of the correct time, each time that said error signal reaches or passes said third predetermined threshold.

As a result of these features, passing of the second and third threshold values allows the electric brake of the generator to be controlled in such a way that from a certain level of depletion of the power reserve of the barrel, the second hand moves periodically right away over an angle of several seconds inviting the wearer of the timepiece to wind the spring barrel. A complementary display device especially dedicated to the power reserve depletion display can thus be eliminated.

Other features and advantages of the invention will appear upon reading the following description, which is given solely by way of example and is made with reference to the attached drawings, in which.

Figure 1:
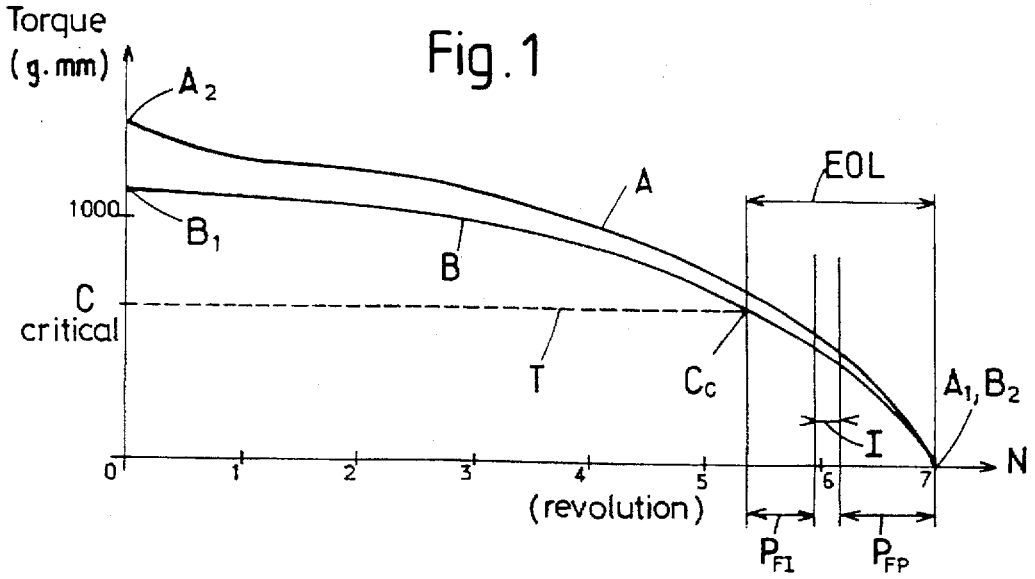
FIG. 1 is a winding/letting down diagram of a spring barrel illustrating, as a function of the number of revolutions of said barrel, how the available torque of the latter varies, the diagram showing, in particular, depletion of the power reserve.

FIG. 1 shows an example of the torque variation provided by a barrel able to be used in an electronic timepiece having a generator according to the invention. The diagram shows gr. mm as a function of the number of revolutions effected by the barrel, both during winding and letting down of the barrel. A revolution of the barrel typically corresponds to a running period of approximately eight hours of the timepiece. Of course, all these values and those which will be given hereinafter are given by way of example only.

Curve A corresponds to the winding. It starts from a point A1 of total let down of the spring and ends, after winding, during which the barrel makes seven revolutions, at a maximum winding point A2 for which the potential torque of the barrel is approximately 1200 gr. mm.

Curve B represents the letting down of the spring during which the barrel provides energy to the timepiece. This curve begins at point B1 at a torque value of approximately 1050 gr. mm (this reduction in torque with respect to the value of point A2 is due to inevitable mechanical losses) and ends at a point B2 of total let down of the spring, this point coinciding of course with point A1.

It will be noted that, if the timepiece has automatic winding, the curves will be covered as a function of the movements imparted to the timepiece, the two winding and letting down operations then being closely imbricated as a function of circumstances.

The diagram also indicates, via a dotted line T, a critical torque value (Ccritical). As long as the barrel is capable of providing a torque greater than this critical value, the generator rotor will always be able to reach the nominal rotation speed for the timepiece to keep the correct time. By way of example only, this value could correspond to a generator output voltage frequency equal to 21.3 Hz.

Beyond a point Cc of intersection of curve B with dotted line T, the timepiece is deemed to enter a condition of "energy depletion" commonly called "EOL" by horologists from the expression "End of Life", by analogy with the end of life of a battery in conventional quartz watches. In the example, point Cc is situated at a degree of letting down of the spring corresponding to approximately 5.3 revolutions of the barrel. The EOL condition extends over a first phase PFI during which the generator is braked intermittently for relatively long periods of time allowing the letting down state of the spring to be indicated to the user via a particular movement of the second hand of the timepiece, in particular via a jerking movement of said hand.

Phase PFI extends over approximately 0.75 of a revolution of the barrel, as is shown by way of example in FIG. 1, and it is followed by a phase called the "pronounced braking" phase PFP of the generator during which the speed of rotation of the latter is maintained at a value such that the rotation of the hands becomes practically imperceptible to the wearer of the timepiece. This phase continues until the energy accumulated in the spring is almost totally depleted (in the example after completion of the seventh revolution).

However, the timepiece will still remain ready to start again if the spring is rewound sufficiently whether the timepiece has automatic or manual winding. It will be seen hereinafter that according to the choice of certain parameters when the circuit is designed, phase PFP may immediately follow phase PFI, or be separated from it by a certain period of time I, the latter being the case shown in FIG. 1.

Moreover, according to an alternative embodiment of the invention which will be described in more detail hereinafter in relation to FIG. 4, at the end of phase PFP, means may be additionally provided for "magnetically" braking the generator's rotor for example by exerting a slight magnetically positioning torque, preferably with the aid of at least one fixed magnet placed in the vicinity of the rotor at a suitably selected distance. This arrangement allows rotation of the barrel to be temporarily blocked, while waiting for the spring to be rewound again, either automatically or manually.

Figure 2:
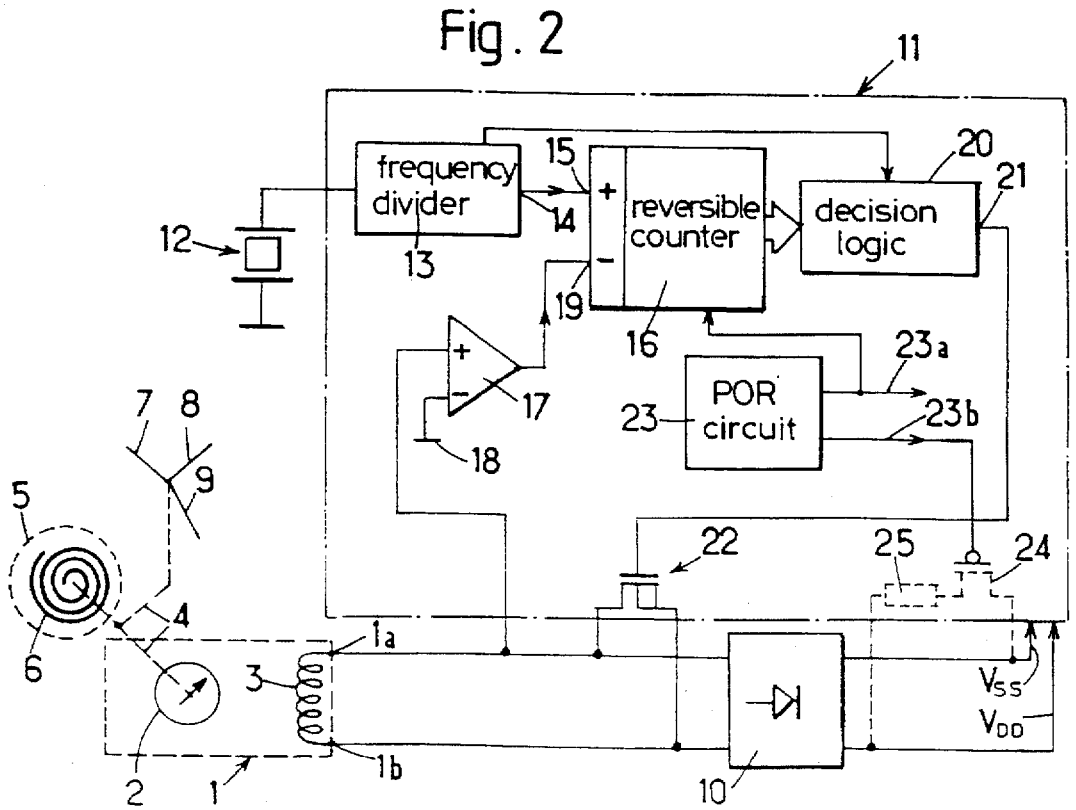
FIG. 2 shows a simplified diagram of the control circuit of the timepiece according to the invention.

Reference will now be made to FIG. 2 which shows a simplified diagram of a timepiece according to the invention.

The timepiece comprises a generator symbolised by the rectangle 1 comprising a magnetised rotor 2 and at least one coil 3. The rotor is mechanically coupled, for example via a gear train 4 symbolised by dotted lines, to a barrel 5 wherein a spring 6 is housed. The latter may be wound by a manual or automatic winding mechanism, which is known and not shown in the figure. Gear train 4 is also coupled to a set of hands for showing the time comprising an hour hand 7, a minute hand 8 and a second hand 9. The hands are coupled to each other in the conventional manner with the appropriate gear ratios, and are rigidly connected to the rotor of generator 1. Consequently, they rotate as long as rotor 2 is moving.

Generator 1 supplies an a.c. voltage at its terminals 1*a* and 1*b* at a frequency of 21.3 Hz (64/3 Hz) and a maximum value of 1.2 volts, for example. Generator 1 is connected to a rectifier for example a double alternation rectifier 10, whose output is connected to an integrated circuit 11, certain components of which form a rotational speed control circuit for generator 1. Integrated circuit 11 receives constant voltages VDD and VSS. It is to be noted that FIG. 2 shows only those components of integrated circuit 11 which are essential for implementing the concept of the invention.

A quartz 12 controls an oscillator forming part of integrated circuit 11 delivering a pulse signal at a frequency of 32 768 Hz to a frequency divider 13, these elements together forming a time base.

This divider comprises a terminal 14 supplying a signal whose frequency corresponds to the nominal frequency which generator 1 must supply in order for hands 7, 8 and 9 to indicate the correct time. In the example described, this nominal frequency is 21.3 Hz (64/3/ Hz). The output 14 is connected to the up counting input 15 of a reversible counter 16.

The terminal 1*a* of generator 1 is connected to one of the inputs of a comparator 17, the other input of which is connected to a reference voltage source 18, such as earth for example. The output of comparator 17 is connected to the down counting input 19 of reversible counter 16.

Comparator 17 supplies an output pulse to reversible counter 16 as soon as the voltage at terminal 1*a* of the generator rises slightly above the potential of earth. Consequently, in the example, supposing that generator 1 rotates exactly at the nominal speed corresponding to a frequency of 21.3 Hz, the content of reversible counter 16 must be zero at the end of each alternation of the generator output voltage.

The output of reversible counter 16 is connected to a decision logic 20 which, as a function of certain predetermined criteria to which we will return hereinafter, generates an output signal at a terminal 21, the criteria being rendered material by wiring a certain number of elementary gates which make up this decision logic. The man skilled in the art, familiar with these criteria after having examined the present description, will be able to make the decision logic so it has not been described in detail here.

The signal present at output terminal 21 is applied to the control electrode of a switching component 22 selectively controlling the braking of generator 1. This switching component 22 may be a MOS transistor whose source-drain path is connected between terminals 1*a* and 1*b* of generator 1.

The control circuit according to the invention also uses a circuit 23 called a "starting" circuit usually designated a POR circuit (Power-On-Reset). As the man skilled in the art knows, such a POR circuit is provided, in particular, in most integrated circuits and in particular in those used in electronic timepieces, for setting the components of the integrated circuit in a certain logic state so that when voltage is applied thereto, such components may begin to operate with the proper logic state.

In the device according to the invention, starting circuit 23 comprises two complementary outputs 23*a* and 23*b*, changing logic level when the voltage supplied to integrated circuit 11 passes, respectively in one direction or the other, a predetermined value. In the example described, this value may be approximately 0.7 volts, ignoring any hysteresis which the signal may undergo.

As far as the present invention in particular is concerned, output 23*a* of starting circuit 23 is connected to reversible counter 16 whose content it sets at "1", when its logic level passes from "0" to "1".

Output 23*b* is connected to a pronounced braking switching component 24. This latter may be formed by a PMOS transistor whose drain-source path is connected in series to a resistor 25, these two components together forming a shunt mounted in parallel on supply terminals VDD and VSS of integrated circuit 11. The switching component becomes conductive, when the logic level at output 23 of starting circuit 23 passes from "1" to "0".

The operation of the timepiece according to the invention is as follows.

When after the complete winding of the spring of barrel 6, the timepiece operates normally, the control circuit according to the invention is responsible for limiting the rotational speed of generator 1, since, in the absence of such a limitation, the generator would tend to race until depletion of the energy accumulated in the spring while driving the hands at great speed.

The rotational speed limitation is controlled as a result of the presence of braking control transistor 22 which can short circuit terminals 1*a* and 1*b* of the generator and thus electrically brake the latter, when it receives a corresponding signal from decision logic 20. The latter permanently analyses the content of reversible counter 16 and supplies a control signal to transistor 22 as soon as the count of counter 16 becomes equal to "−1". It is in these circumstances that the generator frequency is greater than that supplied by divider 13 and that hands 7, 8 and 9 will tend to rotate too quickly. It is then useful to make transistor 22 conductive in order to return the generator speed to its nominal speed corresponding to the indication of the correct time.

Thus in order to maintain the nominal speed of generator 1, the control circuit permanently compares the standard frequency provided by divider 13 to that of the voltage supplied to terminal 1*a* of generator 1 and analysed by comparator 17.

In the example described, this mode of operation lasts for approximately 5.3 revolutions of barrel 5 (a little more than forty or so hours) assuming of course that spring 6 is not manually or automatically rewound. Gradually as this period of time elapses, the recurrence of successive brakings becomes smaller and smaller. It is to be noted that during this mode of operation, the recurrent short circuiting of generator 1 by transistor 22 will not disrupt the operation of integrated circuit 11, two charging capacitors (not shown) of a relatively large capacitance and provided in rectifier 10, allowing the necessary voltage to be permanently provided for this purpose.

When the value of the torque provided by barrel 5 falls to value Ccritique (point Cc in FIG. 1), the generator rotates at a speed such that its frequency is no longer sufficient for the pulses in reversible counter 16 originating from divider 13 to be compensated by the pulses processed by comparator 17. However, the voltage which the generator provides to integrated circuit 11 is still sufficient to make it operate. The content of the counter is thus increased to a predetermined threshold value corresponding for example to its total positive capacity (counter overflow). In the example, this value may be equal to 512, which corresponds, taking account of the frequency with which the signal at terminal 15 of counter 16 causes it to progress, to approximately 24 seconds. Decision logic 20 is also wired to detect this predetermined threshold value.

Consequently, as soon as this value is reached, decision logic 20 makes braking transistor 22 conductive to reduce the speed of rotation of generator 1. The latter having rotated at a lower speed than the nominal speed during the filling of up/down counter 16, hands 7, 8 and 9 have all become slow with respect to the correct time, the lag being equal to the filling time of said counter (24 seconds in the example).

Generator 1 being braked, the voltage supplied to integrated circuit 11 falls to a low value and as soon as the charging capacitors of rectifier 10 are sufficiently discharged, this value becomes less than that at which the integrated circuit can still operate properly (typically 0.7 volts) This, amongst other things makes braking transistor 22 non-conductive, said transistor no longer receiving a control signal from decision logic 20. Moreover, since the voltage at the terminals of the integrated circuit falls below the value at which starting circuit 23 reacts, the logic levels of the signals at outputs 23*a* and 23*b* are reversed.

Thenceforth, generator 1 may pick up speed and the voltage supplied to integrated circuit 11 may increase until starting circuit 23 reacts again and causes the logic levels at terminals 23*a* and 23*b* to change state in reverse directions, while at the same time integrated circuit 11 begins operating again.

Figure 3:
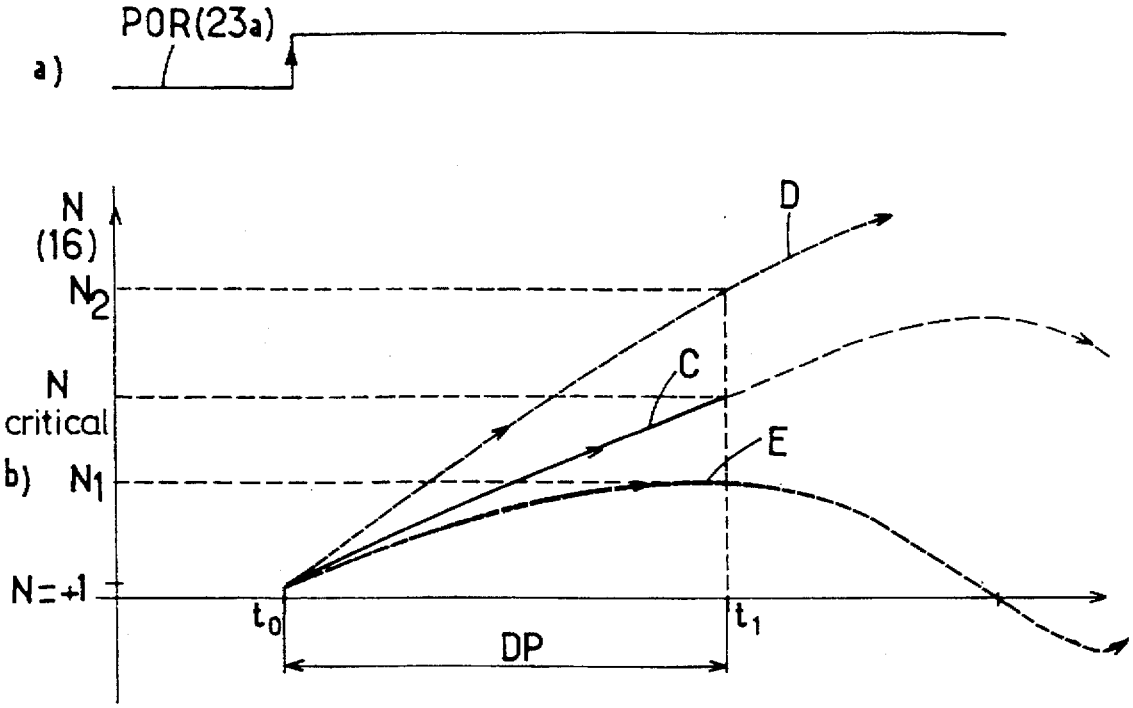
FIG. 3 is a diagram showing, as a function of time, the variation in the content of a reversible counter used in the control circuit of FIG. 2, in order to illustrate the operation of the latter.

The operations which have just been described take place at the very beginning of phase PFI which may however last several hours if spring 6 is not rewound, which translates into an intermittent advance of the "EOL" type known for motor driven quartz watches. The remainder of the operation of the timepiece during this phase is illustrated in FIG. 3. This Figure shows in a) the variation in the logic level of output 23*a* of starting circuit 23 at this stage of operation. The diagram b) of FIG. 3 shows how the number N contained in reversible counter 16 (curve C) may vary from the moment when the POR signals at terminals 23*a* and 23*b* change state in reverse directions as has just been described. This moment is indicated by the time to in b) of FIG. 3.

It has been seen that signal POR (output 23) is applied to counter 16. Consequently, when this signal passes to "1" at time to, the number N contained in this counter 16 passes to +1. Moreover, decision logic 20 is connected to divider 13 to receive therefrom a time signal establishing a predetermined period DP which in the present example is selected to be 4 seconds. Decision logic 20 is also capable of providing a control signal for transistor 22, when at the end of this predetermined period DP, the content of counter 16 reaches a critical value (N=Ncritical) or passes this value.

Despite the fact that during phase PFI, generator 1 always rotates at a lower speed than the nominal speed, it will nonetheless rotate the hands sufficiently quickly in relation to the nominal speed of the correct time and, as regards the second hand, over a sufficient angle (typically of several seconds at a time) for the phenomenon to be easily perceptible to the user of the timepiece and to encourage him to effect the rewinding.

However, when generator 1 rotates during phase PFI, the pulses which are supplied to counter 16 via comparator 17 always have a lower frequency than that provided by divider 13. Counter 16 will thus fill itself in the positive direction. The criterion imposed by decision logic 20 thus consists of controlling braking transistor 22 if the content of the counter reaches value Ncritical or passes this value prior to expiry of predetermined period DP fixed by divider 13. FIG. 3 illustrates this process via two curves C and D, curve C corresponding to the case in which value Ncritical is reached just at the expiry of the predetermined period. Curve D shows the case where, at the expiry of predetermined period DP, counter 16 contains a value N2 much higher than the critical value. When decision logic 20 thus controls braking transistor 22 at the end of period DP, generator 1 is braked, the voltage provided to circuit 11 decreases sharply to the point that the latter stops operating, braking transistor 22 is again made non-conductive and the generator once again restarts driving the second hand at a fitful pace. This process may be repeated as long as one or other of the following two events do not intervene.

The first event consists of the user manually rewinding the spring or starting to wear the timepiece imparting his movements thereto. In such case, the number accumulated in counter 16 will decrease, since generator 1 will rapidly resume the nominal speed and send pulses to counter 16 at the same rhythm as divider 13. This eventuality is represented in FIG. 3 by curve E.

The other event comprises more pronounced depletion of the power reserve, in which case, when the generator restarts, the voltage which it supplies will no longer be sufficient to supply integrated circuit 11. It will be recalled that, in the example described, the corresponding value is 0.9 volts. The operation then enters the intermediate period designated by I in FIG. 1, during which the hands rotate permanently at a very slow speed, the generator not being able to be braked by transistor 22.

Since the speed of the generator is further reduced, starting circuit 23 will react at the moment when the voltage supplied to integrated circuit 11 passes the value of 0.7 volts in a downwards direction, for example. When this occurs, the signal at terminal **23*b* passes to "1" and makes transistor 24 conductive. This connects between supply terminals VDD and VSS, the shunt formed by this transistor 24 and resistor 25. The latter is selected at such a value that the current being established in this shunt absorbs a quantity of energy such that barrel 5** can no longer drive the hands at a speed perceptible to the wearer of the timepiece. This very low speed rate is established during the entire pronounced braking phase PFP which lasts until the almost total depletion of the power reserve.

Pronounced braking phase PFP, although optional, is useful for informing the wearer of the timepiece of a total stop (the rotation of the second hand is then too slow to be perceptible to the wearer). Without this phase, the inattentive wearer could have the impression that the timepiece is still working, the hands still advancing at a speed, albeit a slow speed, but still perceptible to the wearer, especially during a certain period of time immediately following intermittent braking phase PFI. It is, moreover, for the same reason that it is useful to reduce as much as possible the duration of period of time I (during which the hands already rotate quite slowly, but freely), which may be achieved by selecting very close values for the minimal voltage at which the integrated circuit can still operate and for the voltage at which the output signals of starting circuit 23 change level.

It is also to be noted that resistor 25 must be selected at a value such that the shunt which it forms with transistor 24 does not prevent restarting, when the wearer proceeds to rewind spring 5 from pronounced braking phase PFP.

Figure 4:
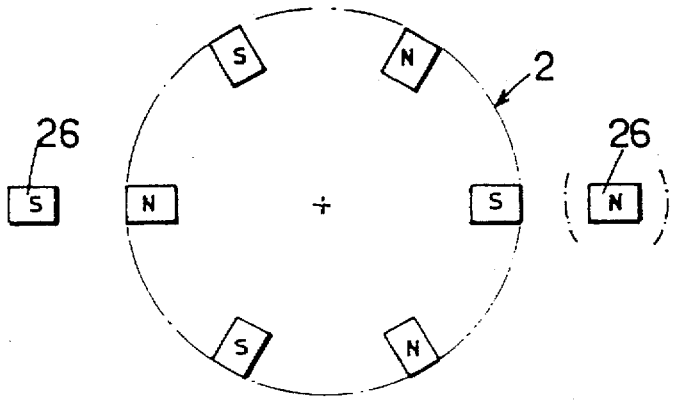
FIG. 4 shows, via a schematic diagram of the generator of the timepiece according to the invention, a particular alternative embodiment of such generator.

FIG. 4 illustrates an alternative embodiment of the invention which may be added as a complement to the unit to totally prevent rotation of generator 1 at the end of pronounced braking phase PFP. This alternative consists of placing close to the periphery of rotor 2 of generator 1 one or more magnets having very low attraction power and capable of imposing a slight positioning torque on this rotor, such torque having to be lower than the torque which the barrel is capable of providing when the power reserve is almost entirely depleted, in order not to prevent restarting.

In the embodiment shown by way of example in FIG. 4, rotor 2 shown in plane comprises magnets oriented perpendicular to the plane of the drawing. They are alternately North and South according to the contour of the rotor. Magnets 26 are placed beside the rotor according to the same orientation.

What is claimed is:

1. An electronic timepiece comprising:

an a.c. voltage generator connected to a rectifier arranged to supply an electronic circuit of the timepiece, a spring barrel coupled to said generator for the driving thereof, a set of time indicating hands also driven by said barrel, said electronic circuit comprising:

a time base arranged to provide a standard frequency signal, comparing means for comparing the frequency of said time base to the frequency of said a.c. voltage in order to generate an error signal, and verifying means connected to said comparing means for verifying whether said error signal passes a first predetermined threshold, and braking means controlled by said verifying means for electrically braking said generator when said error signal passes said first predetermined threshold, wherein said verifying means are also arranged to verify whether said error signal passes a second predetermined threshold greater than said first predetermined threshold and evidencing a predetermined degree of depletion of the power reserve of said barrel, said braking means being also controlled when said second threshold is passed, said verifying means being further arranged to verify whether, after said error signal has passed said second predetermined threshold, said error signal becomes at least equal to a third predetermined threshold, during a predetermined period of time to control said braking means at the expiry of said period of time;

in such a way that said hands indicate said state of depletion by a rotation at a higher speed than the speed corresponding to the indication of the correct time, each time that said error signal reaches or passes said third predetermined threshold.

2. A timepiece according to claim 1, wherein said comparing means comprise a reversible counter whose first input receives the signal from said time base and whose second input receives a pulse signal having the instantaneous frequency of the voltage supplied by said generator.

3. A timepiece according to claim 2, wherein the second input of said reversible counter is connected to the output of a comparator whose first input is connected to an output terminal of said generator and whose second input is connected to a reference voltage source.

4. A timepiece according to claim 2, wherein said verifying means comprise a wired logic arranged to analyse selectively the output of said reversible counter as a function of three of its positions representing respectively said first, second and third predetermined thresholds.

5. A timepiece according to claim 1 wherein said electronic circuit comprises a starting circuit called a POR circuit, and also comprises a resistive shunt arranged to be selectively connected to the output terminals of said rectifier, when said starting circuit notes that the voltage supplied by said rectifier falls below a predetermined value.

6. A timepiece according to claim 5, wherein said resistive shunt comprises a resistor set in series with a switching element whose switching state is controlled by said starting circuit, said resistor being calibrated to allow restarting of the timepiece by rewinding of said barrel after total depletion of the power reserve.

7. A timepiece according to claim 6, wherein it further comprises at least one magnet placed in the vicinity of said generator to impose a positioning torque on the rotor of said generator of such a value that the timepiece can be restarted by rewinding said barrel after complete depletion of the power reserve.

* * * * *